US006039181A

United States Patent [19]

Whiteside

[11] Patent Number: 6,039,181

[45] Date of Patent: Mar. 21, 2000

[54] TRANSIT PACKAGING HAVING REDUCED CONTENT

[76] Inventor: G. Michael Whiteside, 70 Spring Home Road, Barrie, Ontario, Canada, L4N 5H8

[21] Appl. No.: 08/811,056

[22] Filed: Mar. 3, 1997

Related U.S. Application Data

[63] Continuation-in-part of application No. 08/433,848, May 2, 1995, Pat. No. 5,607,056.

[51] Int. Cl.[7] ..... B65D 61/00

[52] U.S. Cl. ..... 206/428; 206/427

[58] Field of Search ..... 206/427–430, 206/434, 435, 158

[56] References Cited

U.S. PATENT DOCUMENTS

| | | | |
|---|---|---|---|
| 4,304,329 | 12/1981 | Graser | 206/434 |
| 4,930,633 | 6/1990 | Gloyer | 206/428 |
| 5,328,024 | 7/1994 | Sutherland | 206/427 |
| 5,425,446 | 6/1995 | Weaver et al. | 206/427 |
| 5,485,914 | 1/1996 | Martin | 206/158 |
| 5,553,705 | 9/1996 | Bakx | 206/158 |
| 5,607,056 | 3/1997 | Whiteside | 206/427 |

*Primary Examiner*—Paul T. Sewell
*Assistant Examiner*—Luan K. Bui

[57] ABSTRACT

A transit packaging having reduced content for straight walled containers includes a paperboard blank. Scores are made along each side of the blank defining side panels for the packaging. The blank includes a retainer having apertures with retaining tabs for engaging each container to prevent sliding movement thereof. Notches are formed at each side of the side panels such that when the panels are folded the notches align laterally. A strap is positioned in the notches and tightened about the blank and containers to form a structural package for palletizing.

3 Claims, 4 Drawing Sheets

TRANSIT PACKAGING HAVING REDUCED CONTENT

This is a continuation-in-part of U.S. patent application Ser. No. 08/433,848, filed May 2, 1995, now U.S. Pat. No. 5,607,056, issued Mar. 4, 1997.

FIELD OF THE INVENTION

This invention relates to transit packaging having a reduced content. In particular, this invention relates to transit packaging for straight walled containers, namely aluminum containers, steel containers or other containers for tinned goods shipped in a multi-pack format.

BACKGROUND OF THE INVENTION

Straight walled containers, such as aluminum containers, steel containers and other containers for tinned goods are widely used in the food industry. In particular, tinned soups, vegetables, juices and soft drinks are currently packaged in straight walled aluminum or steel containers. These containers must be packaged in a multi-pack format for efficient shipping. The multi-pack format requires outer packing support for loading onto pallets.

Full corrugated boxes or shrink wrapped units are generally used to package straight walled containers for transit. Full corrugated boxes are excessively wasteful of cardboard. There is an ongoing trend to reduce total packaging content by at least 10%. Currently, two U.S. States have enacted laws requiring 10% packaging reductions. Replacing the corrugated boxes with trays on which the containers are nested and then shrink wrapped reduces the packaging but creates problems regarding the structural integrity of the trays.

In particular, shrink wrapped trays lack horizontal or lateral stability when piled onto pallets for shipping. The resulting unstable pallet loads are prone to a high rate of damage during transit.

In addition, shrink wrapping is not energy efficient. Extensive energy is required to heat the wrap, most of which is lost to the ambient surroundings.

U.S. Pat. Nos. 3,826,357 and 4,998,615 are examples of packaging which addresses the structural problem. Dividers or stackers elements are added in order to improve the stability of the packages. The necessity of dividers and stacker elements precludes any significant reduction in packaging.

Canadian Patent No. 1,191,819 describes a multi-package assembly. The packages are sandwiched between two sheets of cardboard and held together by strips of frangible adhesive. This type of packaging results in reduced packaging. However, this packaging does not provide lateral structural integrity sufficient to prevent sideways shifting of packages loaded onto a pallet.

SUMMARY OF THE INVENTION

The disadvantages of the prior art may be overcome by providing a transit packaging having a reduced content which also provides structural integrity for maintaining stable pallet loads.

It is desirable to provide a transit packaging comprising a paperboard sheet which extends partially about a plurality of containers. The sheet has a central portion and two sides with at least one strap which wraps about the sheet and containers forming an integral and structural package.

It is further desirable to provide a method to retain the containers onto the paperboard sheets to prevent sliding movement.

According to one aspect of the invention, there is provided a transit packaging comprising a blank of paperboard having side panels foldable to extend substantially perpendicular to the blank and to align notches at opposite sides of each of the side panels, a retainer for retaining like containers onto the blank in a regular side by side pattern between the side panels, and at least one strap for positioning in the notches and wrapping about the blank once the like containers are retained in the blank and the sides folded. The strap urges together the like containers forming a structural package.

According to another aspect of the invention, there is provided a method of packaging like containers using a paperboard blank. The blank has opposed side panels foldable to extend substantially parallel to each other and each side panel has notches at opposite sides such that when the panels are folded the notches are horizontally aligned. The like containers each have a straight sides, a top and a bottom and a protrusion. The method comprises the steps of retaining like containers onto the blank in a regular pattern in side by side relation between the side panels. in apertures formed on said blank, each aperture having a plurality of tabs radiating inwardly from a circular score and engaging the lip, and plowing the sides downwardly, and positioning at least one strap in the notches and wrapping the strap about the blank to form a structural package.

According to further aspect of the invention, there is provided a method of packaging like containers using a paperboard blank. The blank has opposed side panels foldable to extend substantially parallel to each other and each side panel has notches at opposite ends such that when the panels are folded the notches are laterally aligned. The like containers each have a straight sides, a top and a bottom and a collar formed on the sides. The method comprises the steps of arranging like containers onto the blank in a regular pattern in side by side relation between the side panels, in apertures formed on said blank, each aperture having a plurality of tabs radiating inwardly from a circular score and engaging the collar, and plowing the sides upwardly, and positioning at least one strap in the notches and wrapping the strap about the blank to form a structural package.

BRIEF DESCRIPTION OF THE DRAWINGS

The present invention will be better understood and more particularly described in the detailed description below and the following figures.

Although several embodiments are illustrated, like reference numbers refer to like parts of the figures.

DETAILED DESCRIPTION OF THE DRAWINGS

Figure 1:
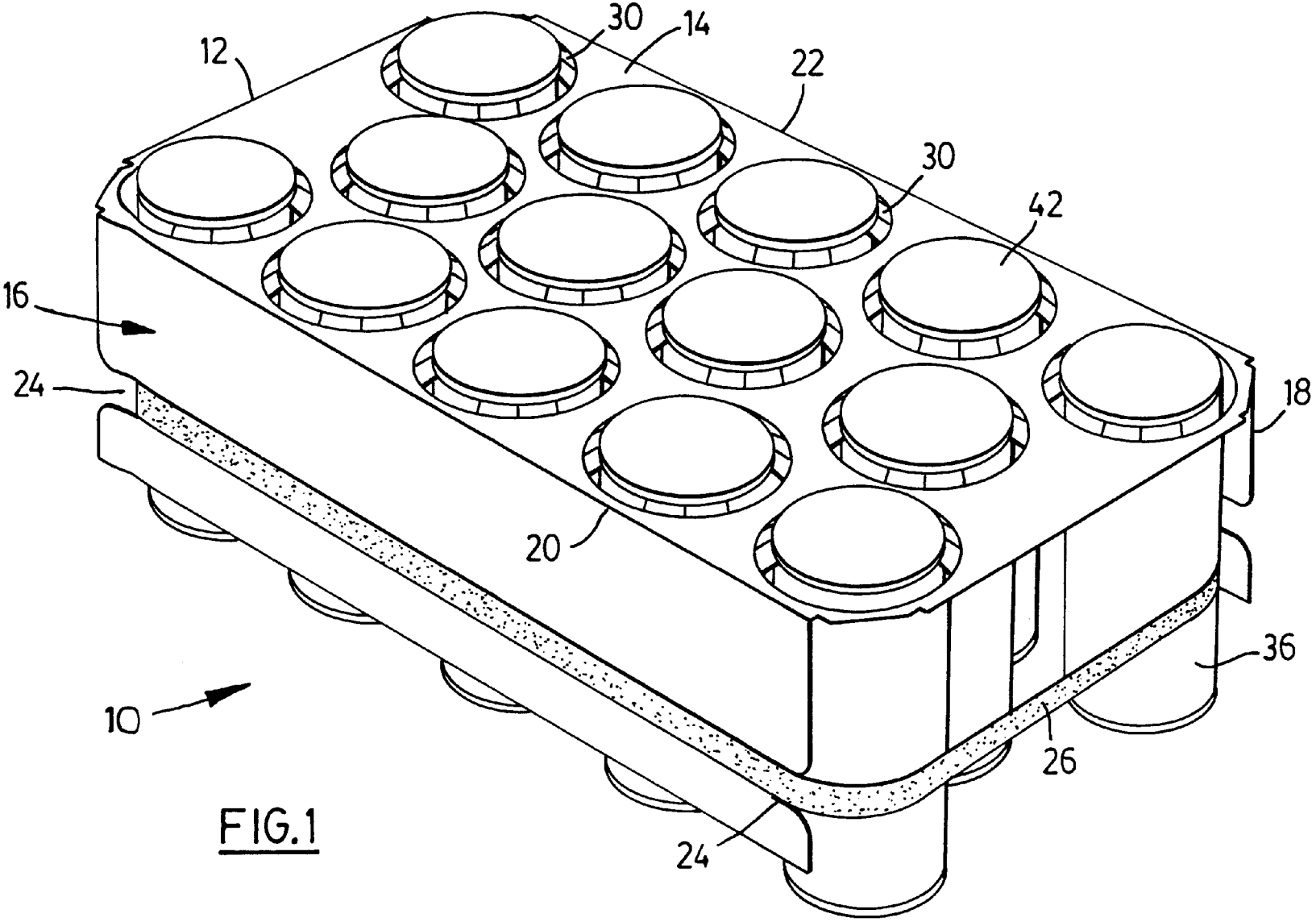
FIG. 1 is a perspective view of a first embodiment of the transit packaging of the present invention in a packaged condition.
Figure 2:
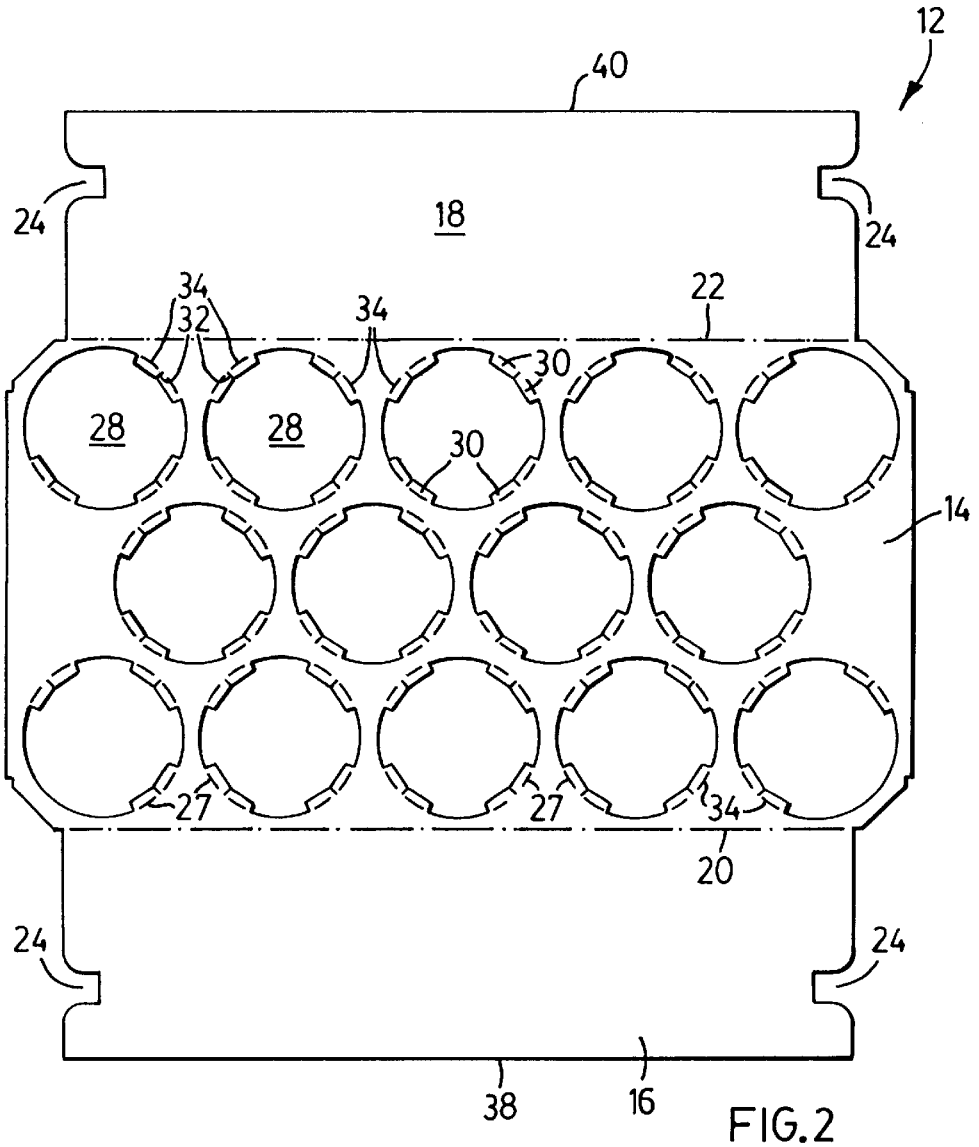
FIG. 2 is a top view of the blank for the transit packaging of the embodiment of FIG. 1 in an unfolded flat condition.
Figure 3:
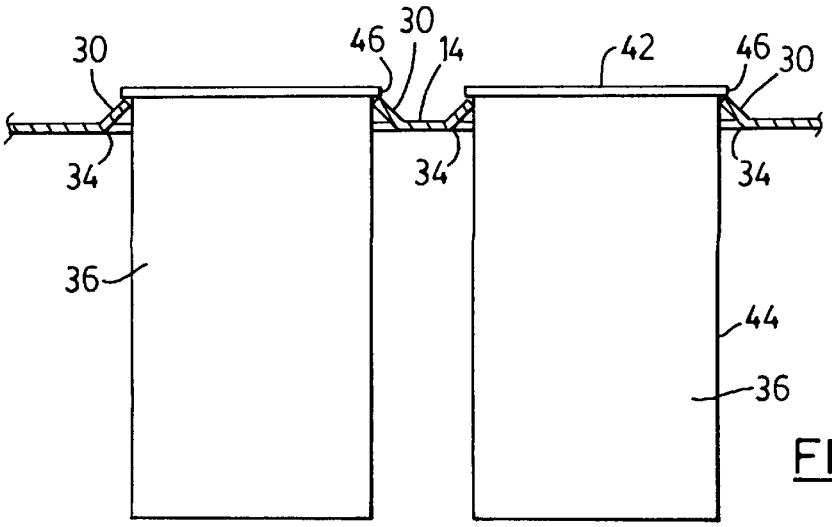
FIG. 3 is a partial cross-sectional view of the transit packaging of the embodiment of FIG. 1 in a packaged condition.

In a first embodiment illustrate din FIGS. 1–3, the packaging 10 comprises a blank 12 having a central panel 14 and two side panels 16, 18 secured about a plurality of containers 36 by a strap 26. Strap 26 is preferably a polyethylene strap conventionally used in the packaging industry.

Referring to FIG. 2, the blank 12 is illustrated in an unfolded condition. Central panel 14 is generally rectangular having a longitudinal extent and a lateral extent. Panel 14 is separated from side panel 16 by longitudinally extending score 20, and from side panel 18 by longitudinally extending score 22. Scores 20 and 22 are applied in a conventional manner.

Blank 12 is preferably made from a cardboard, corrugated cardboard or paper board material. The longitudinal direction corresponds with the longitudinal grain of the material. In the case of corrugated cardboard, the direction of the flutes is the longitudinal direction.

Side panels 16, 18 have aligned notches 24 at each end thereof and equally spaced from the scores 20 and 22. The distance between scores 20, 22 and the outer edges 38, 40 of side panels 16, 18 is such that the side panels 16, 18 have a height when folded downwards less than the height of containers 36.

The blank 12 has a container retaining region comprising a regular pattern of footprints 27. Each footprint 27 has an aperture 28, a concentric circular score 34 and a plurality of tabs 30 formed by die cuts 32. The tabs 30 radiate inwardly from a circular score 34. The die cuts 32 and circular score 34 are applied in a conventional manner.

The footprints 27 are arranged about the central panel in a regular pattern which will space the containers 36 in a side by side relation. Although the preferred embodiment illustrates a regular "5" pattern, other efficient patterns are also contemplated by the present invention.

Containers 36 are like containers, such as beer, soft drinks and juices. The containers 36 are generally characterized by a two piece construction comprising a flat top 42 and a cup shaped bottom 44. The bottom 44 has straight sides and joins the top 42 at a lip 46.

In use, the containers 36 are arranged in the regular side by side pattern. The blank 12 is placed over the containers 36 such that the footprints 27 overlay the tops 42 of the containers. The blank 12 is then moved relative to the containers 36 to engage the containers 36 with a respective footprint 27. The tops 42 of container 36 will be thrust through the apertures 28. Tabs 30 will be thrust outwardly and upwardly to engage the bottom rim of lip 46. In this condition, tabs 30 are biased to retain the containers in engagement with the blank 12. The side panels 16, 18 are plowed downwardly, folding at scores 20 and 22.

FIG. 3 more specifically illustrates the engagement of the tabs 30 with the bottom rim of the lip 46. As shown, the tabs 30 are bent upwardly from circular score 34. The inner edges of tabs 30 are forced over lip 46 and are resiliently urged against and biased towards the sides of container 36 thereby engaging lip 46. The relative sizing of the circular score 34 and length of the tabs 30 should be of sufficient length to ensure full engagement of the tabs 30 with the lip 46.

Strap 26 is then wrapped about the containers 36 and blank 12, and positioned to rest in aligned notches 24. Strap 26 is firmly tightened to retain containers 36 together, while blank 12 provides lateral stability, thus forming transit package 10.

It is readily understood by those skilled in the art that the number of straps 26 and thus corresponding notches 24 may be increased depending on the weight of the containers and contents to be packaged. For instance, larger beverage cans will require at least two straps to maintain structural integrity of the packaging during transit.

Figure 4:
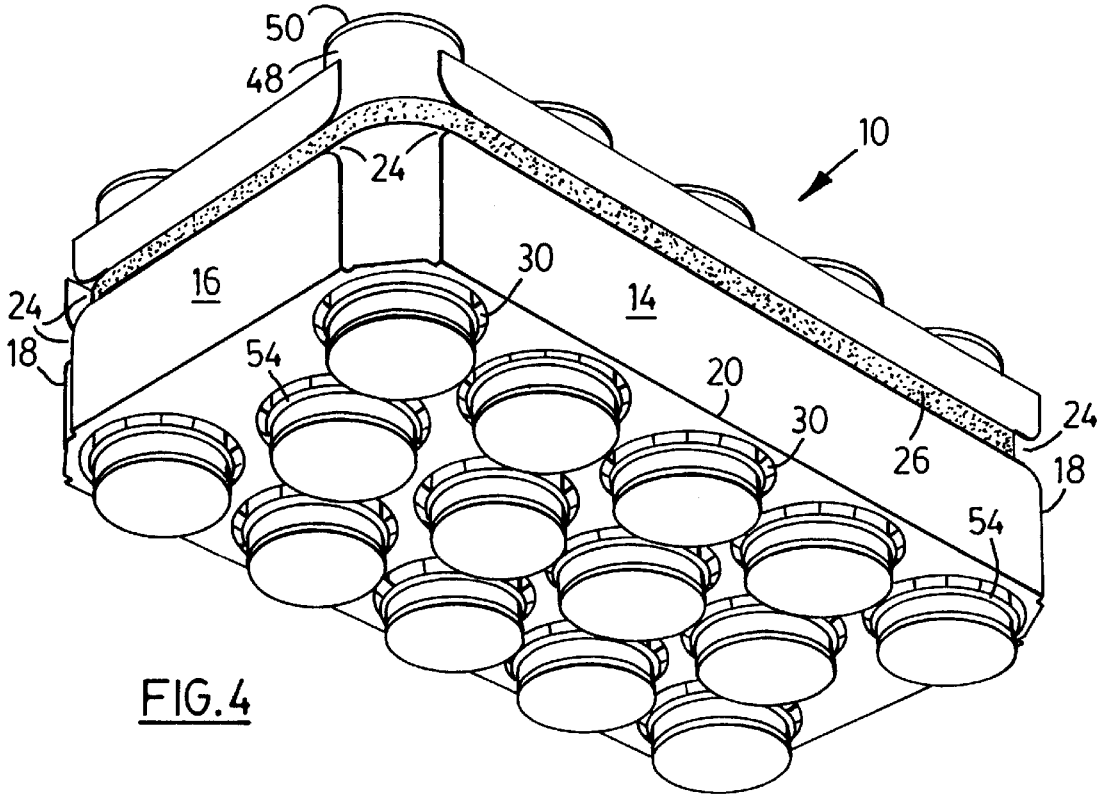
FIG. 4 is a perspective view of a second embodiment of the transit packaging of the present invention in a packaged condition.
Figure 5:
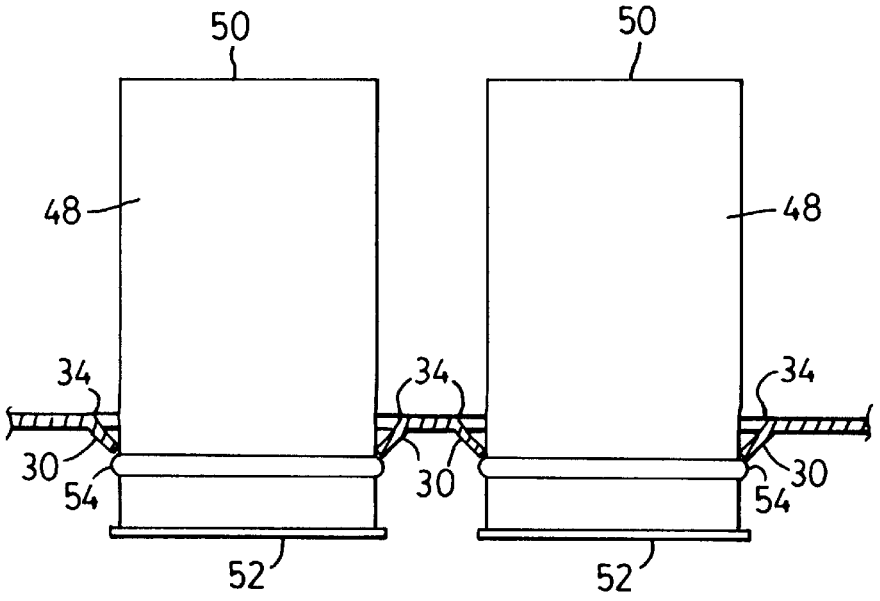
FIG. 5 is a partial cross-sectional view of the transit packaging of the embodiment of FIG. 4 in a packaged condition.

A second embodiment of the transit packaging of the present invention is illustrated in FIGS. 4 and 5. Containers 48 are like containers which are used to package foodstuffs, such as condensed soups and canned vegetables. Containers 48 are generally characterized by a two piece construction comprising a flat top 50 and cup shaped bottom 52. The bottom 52 has generally straight sides with an outwardly protruding collar 54 part way down the sides.

In use, the containers 48 are placed on blank 12 such that the bottoms 52 overlay apertures 28. The side panels 16, 18 are plowed upwardly, folding at scores 20 and 22. The bottoms 52 will extend through the apertures 28 and tabs 30 will be thrust outwardly from aperture 28 and downwardly from circular score 34 abutting the upper surface of collar 54.

FIG. 5 details the abutment of tabs 30 and collar 54. The tabs 30 are bent downwardly from circular score 34. The inner edges of tabs 30 are forced over collar 54 and are resiliently urged against the sides of container 48 thereby abutting the upper surface of collar 54.

Strap 26 is then wrapped about the containers and blank as in the first embodiment to form transit package 10.

The packages 10 of the present invention are loaded onto pallets. The pallet loads can optionally be wrapped in shrink wrap to protect the pallet load from damage, or additional straps may be used to encircle the loaded packages and secure them to the pallet. The pallet load is shipped to its destination, unloaded and the packages 10 may be stacked on shelves.

Containers 36 or 48 are removed from the package 10 by cutting the strap 26 and pulling the container 36 or 48 from the blank.

Alternatively for containers packaged according to the second embodiment, the package 10 may be placed on a sheif, the strap 26 cut, and the blank 12 removed by upwardly sliding it off the containers 48, thus readily displaying the containers 48 for retail.

The quantity of packaging of the present invention is dramatically reduced from prior art cardboard cartons, but the structural integrity of the package is maintained minimizing the risk of damage in transit.

Figure 6:
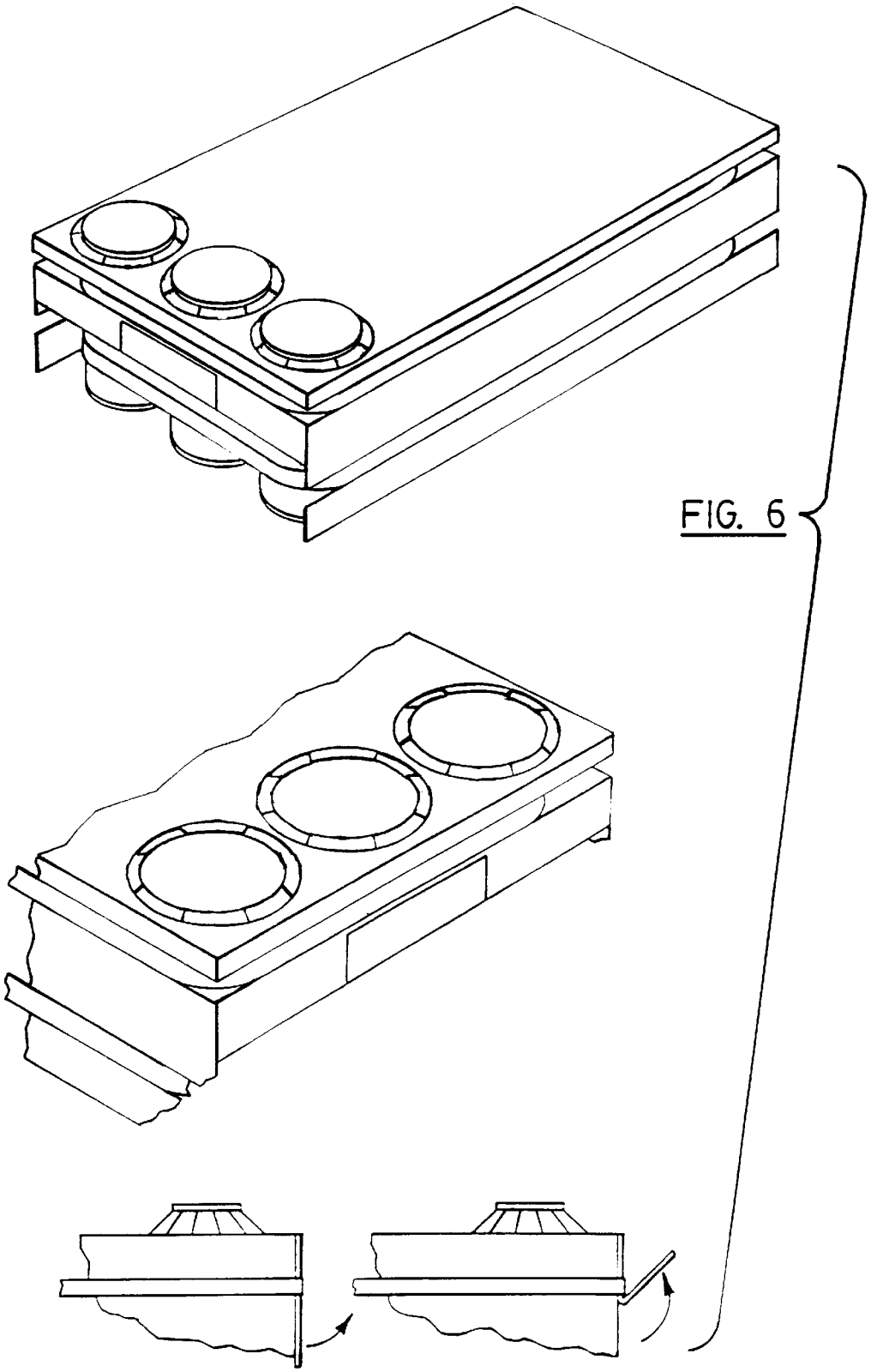
FIG. 6 is a perspective view of a third embodiment of the transit packaging of the present invention.

In FIG. 6, a third embodiment of the present invention is illustrated. The transit packaging of this embodiment is similar to that of the embodiment illustrated in FIGS. 1–3. However, an additional strap is provided which can be used as a carrying handle.

It is apparent to a person skilled in the art that the transit packaging of the present invention could be readily modified without departing from the scope of the invention as claimed.

I claim:

1. A transit packaging comprising:

a plurality of like containers arranged in a regular pattern, said plurality of containers having uniform height, shape and size, each of said like containers having straight sides, a top and a bottom;

a blank of paperboard having scores defining foldable opposed side panels and a central panel for overlying said containers wherein said opposed side panels are foldable to extend downwardly substantially perpendicular to said central panel and substantially parallel to the sides of said containers, said side panels each having a height when folded less than the height of said containers, each of said side panels having an aligned notch at opposite end edges thereof;

said central panel having a plurality of footprints equal in number to said plurality of containers and arranged in said regular pattern corresponding in positions to said containers each said footprints comprising an aperture a circular score concentric with said aperture and a plurality of tabs radiating inwardly from said circular score, wherein said tabs engage protrusions on each said plurality of containers upon extending said containers upwardly through respective apertures, thereby retaining said containers onto said central panel in said regular pattern between said side panels;

at least one strap positioned in said aligned notches and wrapped about said side panels and said containers urging said containers together and retaining said side panels in said perpendicular condition, forming a structural package.

2. A transit packaging according to claim 1 wherein each said protrusion is a lip between the top and sides of each said container.

3. A transit packaging according to claim 1 wherein each said protrusion is a collar on the side of each said container.

* * * * *